United States Patent [19]

Takaoka et al.

[11] 4,441,048

[45] Apr. 3, 1984

[54] CATHODE FOR A GAS DISCHARGE TUBE

[75] Inventors: Hidetugu Takaoka; Yuji Shimazu, both of Hamamatsu, Japan

[73] Assignee: Hamamatsu TV Co., Ltd., Hamamatsu, Japan

[21] Appl. No.: 345,374

[22] Filed: Feb. 3, 1982

[30] Foreign Application Priority Data

Mar. 6, 1981 [JP] Japan ..... 56-32900

[51] Int. Cl.[3] ..... H01J 1/13; H01J 17/06

[52] U.S. Cl. ..... 313/346 R; 313/344; 313/345

[58] Field of Search ..... 313/346 R, 340, 344, 313/270, 629, 346 DC, 345

[56] References Cited

U.S. PATENT DOCUMENTS

| | | | |
|---|---|---|---|
| 2,820,920 | 1/1958 | Penon | 313/346 R |
| 3,018,404 | 1/1962 | Dudley et al. | 313/346 R |
| 3,809,943 | 5/1974 | Collins et al. | 313/346 R X |
| 4,136,227 | 1/1979 | Saito et al. | 313/346 R X |

*Primary Examiner*—Eugene R. LaRoche
*Assistant Examiner*—Vincent De Luca
*Attorney, Agent, or Firm*—Spencer & Frank

[57] ABSTRACT

A tungsten double coil covered with cathode material made from a paste of carbonate mixed with organic solvent. The coil is mounted around a molybdenum cylinder having a cavity in which a heater is installed.

6 Claims, 3 Drawing Figures

CATHODE FOR A GAS DISCHARGE TUBE

BACKGROUND OF THE INVENTION

This invention relates to a cathode of a gas discharge tube which is utilized as an illuminant.

A conventional gas discharge tube will be described hereinafter, particularly the structure and drawbacks of a deuterium gas discharge tube used as an illuminant for a measuring instrument. In a deuterium gas discharge tube operating at a pressure of several torrs of deuterium gas, the anode column of an arc which emits UV rays is used as an illuminant for optical instruments such as a spectroscope. This type of tube stably emits contiguous spectral lines in the UV portion, of the spectrum and is used as an illuminant to provide UV rays.

The structure of such a typical deuterium gas discharge tube is described with reference to FIGS. 1 and 2. FIG. 1 shows a sectional view of a conventional deuterium gas discharge tube. An anode 3, a cathode 4, and a shielding electrode 5 are provided in a vacuum-sealed envelope 2 having a window 1 through which the UV rays can pass. The shielding electrode 5 surrounds the anode 3 and cathode 4, and a small hole 6 is bored through a separator between the anode 3 and the window 1 through which the UV rays can pass. The cathode 4 is set off the line leading from the anode 3 to the small hole 6. Another hole 7 is bored through another separator between the above line and the cathode 4. When the cathode 4 is heated and simultaneously a voltage is applied to the anode 3, an arc occurs in a space covering the anode 3, small holes 6 and 7, and cathode 4. The anode column shrinks at the small hole 6 thereby becoming a bright spot on the front side of the small hole 6.

If such a conventional deuterium gas discharge tube is used as the illuminant for liquid chromatography, fluctuations in intensity directly affect the measured values. That is, the resolving power (accuracy) is determined by fluctuations during the measurement. This is the reason that a deuterium gas discharge tube with a stability as high as possible has been expected. Fluctuations in intensity may mainly be caused by the flicker and shot noise generated by the cathode. The flicker noise may be caused by a small amount of structural disorder at the cathode surface.

Since the cathode of a deuterium gas discharge tube is exposed to an arc, cathode material may be sputtered by ions. Cathode material meet firmly be fastened to the support so as to avoid sputtering of the cathode. Cathode material which is only coated on the metal surface is not satisfactory, and in this case, a solid-state cathode must be used. Thus, in the conventional cathode, the cathode material has been placed within the space around a small-diameter spiral coil 9 formed to build a double coil 8 by winding a tungsten wire filament. (Hereinafter the coils 9 and 8 are called the primary and secondary coils, respectively.) By the way, a paste made from a powder of carbonates, i.e., barium carbonate, strontium carbonate, and calcium carbonate, and a binder composed of nitrocellulose dipped in organic solvent, i.e., butyl acetate are used to fabricate the cathode. Therefore, the double coil is fully stretched by drawing one end of the double coil from the other, and then coating the coil with a suitable quantity of paste. The double coil thereafter is restored to the original state and excessive paste protruding from the primary coil is rubbed off. If this conventional method mentioned above is used for fabricating the cathode by depositing cathode material on the primary coil of the double coil, voids can occur in the deposited cathode material due to its high viscosity. Furthermore, it is difficult to fasten the double coil because of the large elastic deformation in the double coil. It is also difficult to remove excessive cathode material, without removing that covering the gaps between the spiral windings, from the coil surface so as to keep the double coil surface flat. When a cathode fabricated in this way is fastened, by welding its both ends, to the support in a deuterium gas discharge tube and heated by a current flowing through the double coil, both nitrocellulose and organic solvent are removed by evaporation or vaporization, from deposited material and the carbonate is changed to the oxide which finally acts as a cathode material. The oxide is a hard lump of material which tends to generate cracks when a thermal shock caused by applying repetitive heat cycles between high and low temperatures is imposed on the cathode material, and the cracked cathode material tends to drop off during vibration or mechanical shock. A double coil having both ends fastened to the support may be deformed by mechanical expansion when heated by a current flowing through the double coil in a deuterium gas discharge tube, the cracks are made larger by the pressure applied on the cathode material. Discharging occurs at a spot on the cathode surface. If a new cathode surface appears when the cathode surface partly cracks or drops off, discharging goes to a point on the new cathode surface. This is because the new cathode surface provides an emissivity higher than the remaining part. The beam intensity of the UV rays changes before and after the discharging spot moves. This type of deformation may be a cause in the cathode for flicker noise, thereby making the cathode unstable.

SUMMARY OF THE INVENTION

A cathode according to the present invention comprises a double coil with an inner diameter smaller than the outer diameter of a cylinder having a high thermal conductivity, cathode material contained in said double coil and a heater installed in the cavity of said cylinder.

DESCRIPTION OF THE PREFERRED EMBODIMENT

Figure 3:
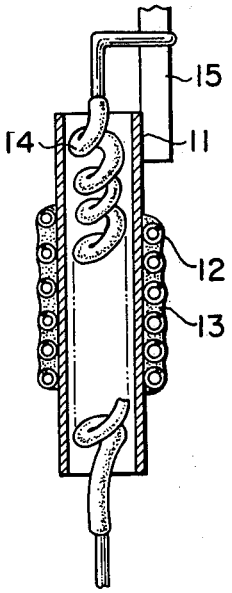
FIG. 3 is a view showing the structure of a preferred embodiment of the cathode formed in accordance with the present invention.

Referring to FIG. 3, a conductive cylinder 11 is made of molybdenum and is 1.6 mm in its outer diameter, 1.4 mm in its inner diameter, and 10 mm in length. The double coil 12 of a tungsten wire of a diameter of 0.05 mm comprises a primary coil having a diameter of 0.2 mm at a pitch of 0.12 mm and a secondary coil further formed by the primary coil having a diameter of 1.3 mm at a pitch of 0.5 mm. The double coil 12 is wound for six turns around the cylinder 11 to form a self-sustaining coil. The reference numeral 13 represents a coated cathode material. A coil with a diameter of 1.3 mm forms the heater of a tungsten wire with a diameter of 0.1 mm.

The coil surface is then covered with alumina. The heater coil has a uniform pitch of six turns per mm, extending toward the axis of the cylinder.

A method of fabricating the cathode in accordance with the present invention will now be described for a preferred embodiment. The cylinder 11 of molybdenum is inserted into the secondary spiral coil of the double coil 12 having an inner diameter a little smaller than the outer diameter of cylinder 11. The double coil 12 is fastened to the outer wall of the cylinder 11 by its own tension. Cathode material paste 13 is then deposited on the double coil 12 and excessive cathode material is removed. Since the double coil 12 fastened to the cylinder 11 is not deformed by the tension applied thereto, no void can occur when the cathode material is deposited on the double coil 12 even by applying pressure to the coil 12 and excessive cathode material can easily be removed. A tungsten coil 14 is then inserted into the cylinder 11 and one end of the coil 14 is connected to the cylinder 11 through a wire 15. The cathode mentioned above is built into the deuterium gas discharged tube already mentioned and then the cathode material is thereby activated.

Figure 1:
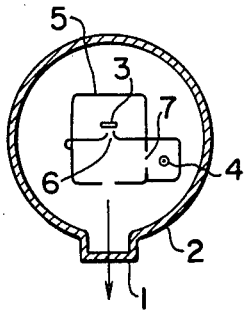
FIG. 1 is a sectional view of a conventional deuterium gas discharge tube.
Figure 2:
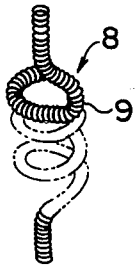
FIG. 2 is a view showing a conventional cathode applied to the discharge tube of FIG. 1.

The characteristics of a deuterium gas discharge tube with the cathode fabricated in accordance with the present invention explained above as referred to FIG. 1 is compared with that of the conventional deuterium gas discharge tube. In the conventional deuterium gas discharge tube which is to be compared, the cathode of FIG. 2 is applied to the tube of the structure depicted in FIG. 1.

Stability of the beam intensity of the UV rays

As described above, flicker noise causes a deuterium gas discharge tube to stepwise decrease or increase the intensity of the emitted UV rays. Persons skilled in the art call this type of noise the step noise. And this flicker noise is one which affects particularly the result of liquid chromatography, etc. which must be carried out by UV rays which are continuously stabilized for a long period of time, because the process requires stable UV rays. One hundred pieces of new tubes using the cathode fabricated in accordance with the present invention and another one hundred pieces of the conventional tubes were operated at a discharge current of 300 mA for 500 hours. Step noise was found in thirty pieces of the conventional tubes and the noise component was on the order of $10^{-3}$ of the total beam energy. However, no step noise was found in the new tubes fabricated in accordance with the present invention and the noise component was in this case on the order of $10^{-5}$ of the total beam energy.

The reason for a noise component of the order of $10^{-5}$ in the total beam energy is that the cathode material for the most part did not fall off, which will be described later, and that this type of noise is caused by local cracking or falling off because discharging from cathode material on the outer wall of the cylinder substrate having a high thermal conductivity occured in all parts of the cathode maintained at a uniform temperature distribution.

Mechanical strength of cathode material

Vibration with an amplitude of 7.5 mm at a frequency of 80 Hz was applied for a period of 10 minutes to ten pieces of the deuterium gas discharge tubes and then struck to inspect the cathode. It was found by inspection that in almost all of the cathodes the cathode material partially fell off.

For another ten pieces of the conventional deuterium gas discharge tubes vibration was applied for a period of 30 minutes, and it was found by inspection that the cathode material of all tubes fell off. On the other hand, for the deuterium gas discharge tubes having the cathode fabricated in accordance with the present invention, vibration with an amplitude of 7.5 mm at a frequency of 80 Hz was applied for 30 minutes, and the tubes were then destroyed and the cathodes were inspected with a loupe. It was found that the double coils taken out of the envelope were not deformed and although the cathode material was cracked, it did not fall off, but only was inserted into the coil gaps.

In accordance with the present invention, the rugged cathode, as fully described above in detail, can be fabricated by a simple fabrication process, and the deuterium gas discharge tube of this invention has a greatly improved stability in the beam intensity of the UV rays, compared with the conventional tubes. This enables a deuterium gas discharge tube to be used for making a high precision analysis that has not been made previously.

The detailed description given mentioned above is relevant to a preferred embodiment of the deuterium gas discharge tube cathode fabricated in accordance with the present invention. The structure of the cathode made in accordance with the present invention is applicable to any other types of gas discharge tubes to be fabricated in accordance with the high stability requirements.

What is claimed is:

1. A cathode of a gas discharge tube comprising:

a cylinder having outer and inner surfaces;

a double coil surrounding the outer surface of said cylinder, said double coil having an inner diameter which is smaller than the diameter of the outer surface of said cylinder and having a relatively high thermal conductivity;

a cathode material deposited on said double coil; and a heater positioned within said cylinder surrounded by the inner surface thereof.

2. A cathode of a gas discharge tube as defined in claim 1, wherein said double coil and said cylinder are fastened together in a concentric arrangement.

3. A cathode of a gas discharge tube as defined in claim 1, wherein the cathode is made from a paste of said cathode material.

4. A cathode of a gas discharge tube as defined in claim 3, wherein the paste of said cathode material is made from a powder of carbonates and a binder composed of nitrocellulose dipped in organic solvent.

5. A cathode of a gas discharge tube as defined in claim 4, wherein said carbonates are barium carbonate, strontium carbonate and calcium carbonate.

6. A cathode of a gas discharge tube as defined in claim 4, wherein the organic solvent is butyl acetate.

* * * * *